United States Patent [19]

Hobbs

[11] Patent Number: 4,946,061

[45] Date of Patent: Aug. 7, 1990

[54] RECLOSABLE OPENING DEVICE FOR A CONTAINER

[75] Inventor: Douglas H. Hobbs, Seabrook, Tex.

[73] Assignee: Shell Oil Company, Houston, Tex.

[21] Appl. No.: 411,764

[22] Filed: Sep. 25, 1989

[51] Int. Cl.[5] ..... B65D 45/00

[52] U.S. Cl. ..... 220/243; 220/255; 220/282; 215/301

[58] Field of Search ..... 220/243, 246, 247, 248, 220/250, 255, 256, 260, 281, 282; 215/301

[56] References Cited

U.S. PATENT DOCUMENTS

| | | | |
|---|---|---|---|
| 1,349,510 | 8/1920 | Jochumsen | 220/243 |
| 3,119,509 | 1/1964 | Livesay et al. | 220/24 |
| 3,236,409 | 2/1966 | Cross et al. | 220/47 |
| 3,289,881 | 12/1966 | Ganung | 220/60 |
| 3,700,135 | 10/1972 | Collier | 220/243 |
| 3,902,625 | 9/1975 | Schmidhuber | 220/246 |
| 3,926,051 | 12/1975 | Katzman | 220/281 X |
| 3,982,656 | 9/1976 | Kusmierski et al. | 220/238 |
| 4,023,703 | 5/1977 | Strobe et al. | 220/268 |
| 4,034,888 | 7/1977 | Strauss | 220/260 |
| 4,039,100 | 8/1977 | Wells | 220/269 |
| 4,106,662 | 8/1978 | Strobe et al. | 220/268 |
| 4,113,134 | 9/1978 | Heintzelman | 220/256 |
| 4,122,970 | 10/1978 | Amabili | 220/256 |
| 4,162,742 | 7/1979 | Vogt | 220/269 |
| 4,215,791 | 8/1980 | Brochman | 220/258 |
| 4,238,046 | 12/1980 | Vogt | 220/269 |
| 4,410,101 | 10/1983 | Vogt | 220/257 |
| 4,434,906 | 3/1984 | Florczyk et al. | 220/268 |
| 4,461,605 | 7/1984 | Stanek et al. | 413/8 |
| 4,501,375 | 2/1985 | Katsura et al. | 220/270 |
| 4,513,876 | 4/1985 | Buchner | 220/270 |
| 4,609,123 | 9/1986 | Poncy | 220/258 |
| 4,741,451 | 5/1988 | Hobbs | 220/271 |
| 4,746,032 | 5/1988 | Huang | 220/256 |

*Primary Examiner*—Stephen Marcus
*Assistant Examiner*—Nova Stucker

[57] ABSTRACT

An easy opening and reclosable top closure assembly for a container is provided. The assembly comprises a container top having a substantially circular aperture of a given diameter formed therein, a closure disc having a diameter greater than the given diameter of the aperture whereby the closure disc completely covers the bottom of the aperture when it is positioned in the closed position, a cover disc having a diameter at least as great as the given diameter of the aperture whereby the cover disc completely covers the top of the aperture when it is positioned in the closed position, and a narrow hinged post connecting the closure disc and the cover disc, said post being of such a length whereby the discs are tightly frictionally engaged against the container when opened and said post being sufficiently flexible that the cover disc can be rotated and inserted through the aperture.

16 Claims, 1 Drawing Sheet

FIG. 1
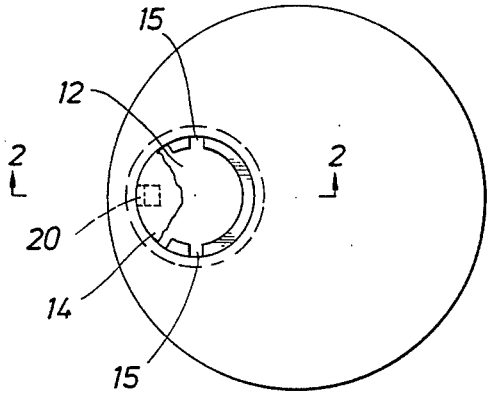
FIG. 3
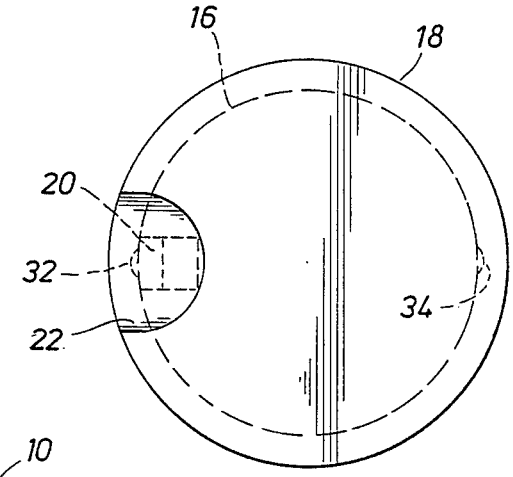
FIG. 2
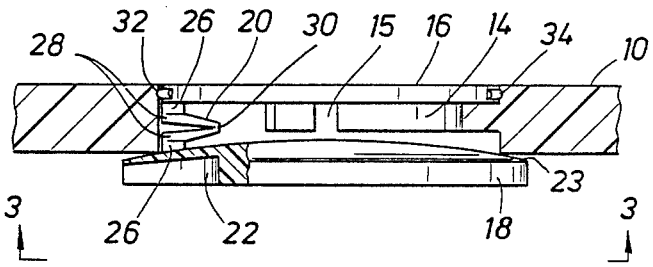
FIG. 4
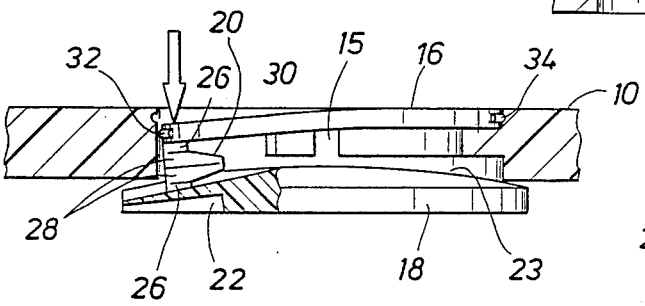
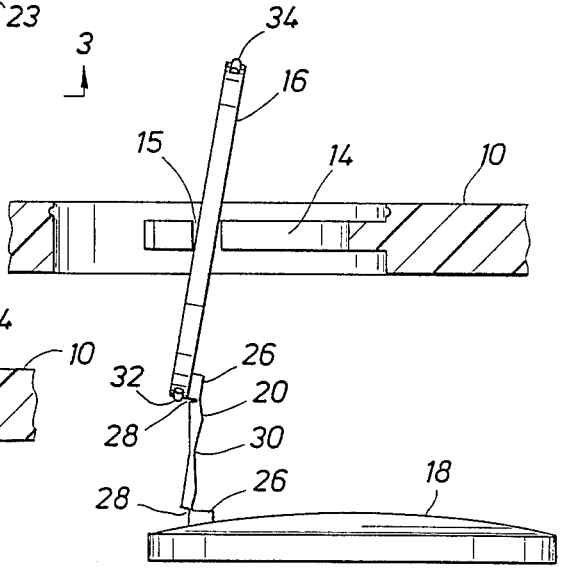
FIG. 5
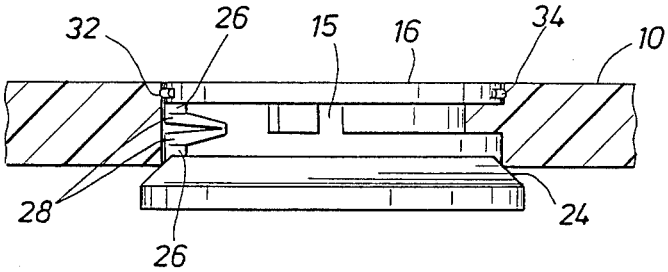
FIG. 6

RECLOSABLE OPENING DEVICE FOR A CONTAINER

BACKGROUND OF THE INVENTION

This invention relates to a reclosable opening device which can be used for containers, especially beverage containers. The invention particularly relates to such a closure assembly for use in carbonated beverage cans and particularly in plastic cans.

In the past, the closure assemblies in a container wall which were most popular for usage in commercial packaging were those which could be removed from the container, such as tear off or tear out closures. However, resistance to the use of this type of throw-away closure or opening assembly increased due to pollution requirements and because most users tended to separate the assembly completely from the container. When such closure assemblies were made of metal or even some plastic materials, they posed a hazard to other parties due to the possibility of cutting or the like.

Thus, a demand was created for closure assemblies which were of relatively simple construction and which remained integral with the container with which they were associated after the closure assembly was opened to provide access to the contents of the container. A wide variety of such closures have been designed and many have been put into commercial use.

Many of these closure assemblies are well designed in that they provide easy and safe access to the container contents. However, once these closure assemblies are opened, there is no way to reclose the container should the consumer not wish to consume the entire contents. The present invention provides a closure assembly which is environmentally sound because it does not detach from the container, is easy and safe to open and is reclosable so that the contents of the container, such as a carbonated beverage, can be partially consumed and then saved for later consumption without contamination.

SUMMARY OF THE INVENTION

This invention is an easy opening and reclosable top closure assembly for a container. The assembly comprises a container top having a substantially circular aperture of a given diameter formed therein, a closure disc having a diameter greater than the given diameter of the aperture whereby the closure disc completely covers the bottom of the aperture when it is positioned in the closed position, a cover disc having a diameter at least as great as the given diameter of the aperture whereby the cover disc completely covers the top of the aperture when it is positioned in the closed position and a narrow hinged post connecting the closure disc and the cover disc. The post is of such a length whereby the discs are tightly frictionally engaged against the container top in the opened position and the post is hinged and flexible so that the cover disc can be rotated and inserted through the aperture.

In a preferred embodiment, there is a support flange within the aperture recessed from the top surface of the container top and extending greater than one-half of the way around the aperture to preclude cover disc from pushing through the aperture. The cover disc rests on this support flange such that its upper surface is flush with the top surface of the container top. Most preferably, the support flange is also recessed from the bottom surface of the container so that the sealing area within the container remains relatively circular. In order the facilitate the insertion of the cover disc through the aperture, opposing slots may be cut in the support flange.

The closure disc preferably has an arcuate surface which contacts the container top at the aperture when the closure disc is in the closed position. Alternatively, the closure disc may have a frustoconical section wherein the tapered sides thereof contact the aperture. The underside of the closure disc is preferably cut away under the flexible post to provide a flexible area for easier opening of the closure assembly.

The present invention has several advantages. One of these is that the opening force is low and is set by varying the geometries of the support flange and the cover disc. Another is that the opening force is applied in a simple continuous pushing motion. The device easily seals at low pressures. The opening force must be applied at a specific location which lowers the possibility of premature opening. The device can easily be made tamper evident. Other advantages will become apparent from a reading of the following description.

BRIEF DESCRIPTION OF THE DRAWINGS

FIG. 1 is a top view illustrating the container top and the aperture with the support flange and the slots cut therein.

FIG. 2 is a view taken across 2—2 of FIG. 1.

FIG. 3 illustrates the closure assembly with the cover disc attached to the closure disc by the hinged post.

FIG. 4 illustrates the closure assembly beginning the opening process.

FIG. 5 illustrates the disc being inserted through the container top.

FIG. 6 illustrates an alternative design for the closure disc.

DETAILED DESCRIPTION OF THE INVENTION

The closure assembly of the present invention is particularly applicable to use in plastic containers although it can be used in containers made of other materials such as aluminum and steel. Polypropylene used in combination with an oxygen barrier material such as ethylene vinyl alcohol copolymers or polyvinylidene chloride is preferred but other injection moldable thermoplastics may also be used. The assembly is well suited for use with carbonated beverage containers since the internal pressure of the container will keep the closure disc in place at the aperture and thus sealing the contents within.

The container top has a substantially circular aperture therein. The aperture may be somewhat ellipsoidal but best results are achieved if it is as close to circular as possible. The contents of the container are dispensed through this aperture. The aperture has a given diameter against which the diameters of the cover and closure discs are compared.

When plastic materials are used, there is always the danger of distortion of the parts. The container top should be designed to minimize the deformation of the aperture so that the closure and cover discs are able to maintain the integrity of the sealing of the contents.

It is the closure disc that provides the actual sealing of the contents within the container. The disc may be of a flat or other design but must be sufficiently great in diameter to completely cover the aperture on the inside of the container top. It is preferred that the closure disc present some kind of an arcuate or tapered surface to the aperture. An arcuate or tapered surface will allow a point contact between the closure disc and the bottom of the container. This will increase the sealing pressure since a narrow contact area concentrates the force. The decrease in contact area also makes it easier to open the closure assembly because the closure disc doesn't have to be moved as far as it would if the disc were flat. Further, if the surface is arcuate, a good seal can be formed even if the aperture is somewhat ellipsoidal in shape since the curved surface of the closure disc can rotate. When such a design is used, the curved or tapered surface will allow the maintenance of the sealing even if there is some distortion of the size of the aperture or the disc itself (due to creep, etc.) since the disc may simply slide further up into the aperture due to the action of the pressure within the container. Plastic materials are subject to creep, which is a phenomenon characterized in that such materials will deform when they are placed under stress over a period of time. An elastomeric sealing material may be used to facilitate the forming of a positive seal and to hold the closure disc in place until the container is pressurized.

If a portion of the underside of the closure disc is cut away, the closure assembly will be much easier to open. If the closure disc is a solid piece, then it is very difficult to deform it when pushing inwardly in an attempt to open the container. However, if there is a flexible area, the disc will deform under moderate pressure and the seal can be broken. It is important not to make this area too weak or too large to avoid the problem of accidental opening of the container and excessive creep of this portion closure disc.

The closure disc's geometry is as discussed above. The diameter and thickness can be varied to achieve better performance against creep and also maximum sealing performance depending upon the type of application. The mechanical properties and dimensions of the materials from which the disc is made are important to proper sealing and easy opening features of the closure assembly. The mechanical properties of the material for the device require inherent, processed or fabricated by axial stiffnesses measured by the materials tensile modulus and/or calculated moment of inertia. The device's materials of construction must perform as well as the container's materials in such areas of gas barrier properties, compatibility, taste, odor, etc. The thickness of the closure disc is determined by the materials properties and designed so as to provide sufficient stiffness and creep resistance to the containers pressure. The strength and creep resistance requirements must be balanced with the need of the device to deflect sufficiently to facilitate the sealing and opening of the container. The diameter dimensions of the closure disc are determined by the size and shape of the opening in the container and its proximity to the edge of the container.

The cover disc covers the top of the aperture in the container and is the portion of the closure assembly touched and seen by the consumer. It keeps the closure disc secured to the inside of the container after opening. The cover disc may simply sit on top of the top surface of the container top or it may be mounted flush with that top surface. Flush mounting is preferred because it looks better, seals the area to avoid trapping dirt and is more applicable to making the container tamper resistant.

The thickness of the cover disc and its design should be of sufficient rigidity so that when the opening force is applied, the disc pops out of the container on the opposite side to the point of force application. Additionally, the disc must be rigid enough so that it cannot be easily pushed through the hole in the container during the opening process or after opening abuse.

The cover disc should also have an easily identifiable push point for the opening force to be applied by the consumer. To maintain the position of the disc under the stress of the forces imposed on it from the post, the disc should have small lip snap connections along its edge, where ther post joins it and opposite from that point. These connections fit into corresponding areas that have been molded into the top. These snaps will also provide a tactile response to the consumer during the opening process. Thus, there will be a noticeable snap when the disc is pushed in during the opening process. The lip snap connections will also reduce the change of accidental opening and accomodate any spring forces from the hinged post.

In the present invention, the aperture is provided with a support flange which is recessed from the top surface of the container top. The cover disc may rest on this support flange such that its upper surface is flush with the top surface of the container top. It is important that the support flange extend only part of the way around the aperture so that one edge of the cover disc may rotate downwardly through the aperture to open the closure assembly. It should extend more than halfway around to make it difficult for the cover disc to be pushed all the way through the aperture. It is preferred that the support flange extend around the aperture at least 240 degrees.

When the support flange above is utilized, it is highly preferred that it also be recessed from the bottom surface of the container. This is important because a circular surface of the aperture will be presented to the closure disc for sealing. It is much more difficult to provide a good seal of the contents when there are corners and edges in the aperture surface presented to the closure disc. Recessing the support flange from the bottom of the container top eliminates this problem.

There is provided a connector between the two discs. This connector is a hinged post which serves three purposes. It holds the closure disc and the cover disc together after opening, it accommodates the creep strain and thermal expansion of the components and it transmits the opening force from the cover disc to the closure disc. When an undercut is used, the post must be located over the undercut on the closure disc.

In the present invention, the post is molded with the closure disc and then subsequently attached to the cover disc by a snap connection or some other means. It is also possible to mold all three together. This is preferred. The post must be hinged but strong enough to hold the closure and cover discs together. The hinge is needed to accommodate the length of the closure assembly in its fully extended position. For example, the post could be formed with living hinges at each disc and one centrally located in the post (See FIG. 6).

In the preferred embodiments, the cover disc is set flush to the top of the container in the closed position. When the container is opened, the cover disc is pulled to rest on the outside of the container. The difference in length of the post is the thickness of the cover disc. This extra thickness must be accommodated by the hinged nature of the post since the final length of the post must be the thickness of the top or slightly less to provide a sufficient interference or frictional contact between the discs and the container top in the open position.

The hinged post helps eliminate accidental opening because in actual pushing down on the cover disc will be required—a simple bump would not cause opening like it would if the post was rigid. The hinged post is also important in the attachment of the closure assembly to the container top. The cover disc will be rotated, which is possible because of the flexibility of the post, and inserted through the aperture. When the support flange is used, it will be provided with opposing slots through which the cover disc can be inserted. Once the cover disc is in place on the other side of the container top, it is rotated back and pushed in place over the aperture to protect the contents of the container.

The container will be opened by pushing on the cover disc. This force will be transmitted to the closure disc by the collapsed post. As stated above, it is preferable to have an undercut in the closure disc for easier opening. If an undercut is used, then the post should be in place above the undercut and preferably at the center of the undercut to get maximum flexibility of the membrane to get the container open more easily. If the post was offset, opening would be more difficult. The consumer simply presses on the cover disc above the point where it is attached to the flexible post. When the support flange feature is used, the post will be positioned above the area within the aperture wherein the support flange does not extend. This will allow the rotation downward of the cover disc.

Once the seal has been broken, the closure disc moves away from the opening and the force thereon is decreased. The entire closure assembly may be moved aside to provide a larger opening through which the contents can be dispersed. This is accomplished by simply pushing the cover disc to one side of the aperture. The closure disc will of course follow since it is attached to the cover disc by the flexible post. When it is desired to reclose the container, the cover disc is merely pushed back into position completely covering the aperture.

The invention is more particularly described by reference to FIGS. 1 through 6. FIG. 1 shows the container top 10 which has an aperture 12 cut therein and offset to the side of the top 10. Within the aperture 12 there is a support flange 14 which extends more than half of the way around the aperture 12 but not all of the way. Opposing slots 15 are cut into the support flange 14 to allow insertion of the cover disc 16 therethrough.

FIGS. 2 and 3 illustrates the closure assembly. Cover disc 16 with lip snaps 32 and 34 is attached to closure disc 18 by flexible post 20. FIG. 4 shows the assembly at the moment the seal is broken. Post 20 is attached to the closure disc 18 at a point above the undercut 22 and is preferably located adjacent to the edge of the aperture 12. The post 20 is shown in the collapsed position. Closure disc 18 has an arcuate upper surface 23 which comes into contact with the bottom of the aperture 12 to provide good sealing. Lip snap 32 has released and lip snap 34 will release as the cover disk is pushed down during the opening process.

FIG. 6 illustrates an alternative to the design of the closure disc 18 shown in FIG. 2. This closure disc 18 has a frustoconical shape. The tapered edges 24 are designed to contact the bottom of the aperture 12 to provide good sealing and still allow for a certain amount of creep of the material of the container top 10 which may distort the aperture 12. An undercut 22 should also be provided.

In FIG. 5, the cover disc 16 is being inserted through opposing slots 15. Cover disc 16 is rotated upwardly somewhat thus illustrating the flexibility of the post 20. The post 20 is attached to the discs 10 and 16 at bosses 26 wherein living hinges 28 are formed. The bosses 26 act as contact points when the container is opened for the closure to stay in position and for the cover disc to remain parallel to the top surface. Also, there is a central living hinge 30 formed in post 20 to allow it to collapse as shown in FIGS. 2, 4 and 6. It is preferred that the discs, bosses and post be molded as one piece but, for example, this could be made in two pieces with the boss and post designed for a snap fit, allowing assembly from both sides of the container top.

I claim:

1. An easy opening and reclosable top closure assembly for a container which comprises:

(a) a container top having a substantially circular aperture of a given diameter formed therein, (b) a closure disc having a diameter greater than the given diameter of the aperture whereby the closure disc completely covers the bottom of the aperture when it is positioned in the closed position, (c) a cover disc having a diameter at least as great as the given diameter of the aperture whereby the cover disc completely covers the top of the aperture when it is positioned in the closed position, and (d) a narrow hinged post connecting the closure disc and the cover disc, said post being of such a length whereby the discs are tightly frictionally engaged against the container top in the open position and said post being sufficiently flexible such that the cover disc can be rotated and inserted through the aperture.

2. The closure assembly of claim 1 wherein the closure disc has an arcuate surface which contacts the container top at the aperture when the closure disc is in the closed position.

3. The closure assembly of claim 1 wherein the closure disc has a frustoconical section wherein the tapered sides thereof contact the container top at the aperture when the closure disc is in the closure position.

4. The closure assembly of claim 1 wherein a portion of the underside of the closure disc is cut away to provide a flexible area for easier opening of the closure assembly.

5. The closure assembly of claim 1 wherein there is a support flange within the aperture recessed from the top surface of the container top and extending greater than half of the way around the aperture upon which the cover disc rests such that its upper surface is flush with the top surface of the container top.

6. The closure assembly of claim 5 wherein opposing slots are formed in the support flange such that the cover disc may be inserted therethrough.

7. The closure assembly of claim 5 wherein the support flange is also recessed from the bottom surface of the container.

8. The closure assembly of claim 7 wherein opposing slots are formed in the support flange such that the closure disc may be inserted therethrough.

9. An easy opening and reclosable top closure assembly for a container which comprises:

(a) a container top having a substantially circular aperture of a given diameter formed therein, said aperture having a support flange within which is recessed from the top surface of the container top and which extends greater than half of the way around the aperture, said support flange having opposing slots formed therein, (b) a closure disc having a diameter greater than the given diameter of the aperture whereby the closure disc completely covers the bottom of the aperture when it is positioned in the closed position, (c) a cover disc having a diameter at least as great as the given diameter of the aperture whereby the cover disc completely covers the top of the aperture and rests on the support flange whereby the cover disc completely covers the top of the aperture and is flush with the top surface of the container top when it is positioned in the closed position, said cover disc being capable of being inserted through the slots in the support flange, and (d) a narrow hinged post connecting the closure disc and the cover disc, said post being of such a length whereby the discs are tightly frictionally engaged against the container top in the open position and said post being sufficiently flexible such that the cover disc can be rotated and inserted through the aperture.

10. The closure assembly of claim 9 wherein the closure disc has an arcuate surface which contacts the container top at the aperture when the closure disc is in the closed position.

11. The closure assembly of claim 9 wherein the closure disc has a frustoconical section wherein the tapered sides thereof contact the container top at the aperture when the closure disc is in the closure position.

12. The closure assembly of claim 9 wherein a portion of the underside of the closure disc is cut away to provide a flexible area for easier opening of the closure assembly.

13. An easy opening and reclosable top closure assembly for a container which comprises:

(a) a container top having a substantially circular aperture of a given diameter formed therein, said aperture having a support flange within which is recessed from the top and bottom surfaces of the container top and which extends greater than half of the way around the aperture, said support flange having opposing slots formed therein, (b) a closure disc having a diameter greater than the given diameter of the aperture whereby the closure disc completely covers the bottom of the aperture when it is positioned in the closed position, (c) a cover disc having a diameter at least as great as the given diameter of the aperture whereby the cover disc completely covers the top of the aperture and rests on the support flange whereby the cover disc completely covers the top of the aperture and is flush with the top surface of the container top when it is positioned in the closed position, said cover disc being capable of being inserted through the slots in the support flange, and (d) a narrow hinged post connecting the closure disc and the cover disc, said post being of such a length whereby the discs are tightly frictionally engaged against the container top in the open position and said post being sufficiently flexible such that the cover disc can be rotated and inserted through the aperture.

14. The closure assembly of claim 13 wherein the closure disc has an arcuate surface which contacts the container top at the aperture when the closure disc is in the closed position.

15. The closure assembly of claim 13 wherein the closure disc has a frustoconical section wherein the tapered sides thereof contact the container top at the aperture when the closure disc is in the closure position.

16. The closure assembly of claim 13 wherein a portion of the underside of the closure disc is cut away to provide a flexible area for easier opening of the closure assembly.

* * * * *